US006056039A

United States Patent [19]

Morel et al.

[11] Patent Number: 6,056,039

[45] Date of Patent: May 2, 2000

[54] ROTARY CONTINUOUS CASTING DEVICE

[75] Inventors: Michel Morel, Chelles; Pierre Delassus, Bethune; Gérard Raisson, Nevers, all of France

[73] Assignee: Kvaerner Metals Clecim, Paris, France

[21] Appl. No.: 09/091,353

[22] PCT Filed: Dec. 18, 1996

[86] PCT No.: PCT/FR96/02025

§ 371 Date: Nov. 10, 1998

§ 102(e) Date: Nov. 10, 1998

[87] PCT Pub. No.: WO97/23318

PCT Pub. Date: Jul. 3, 1997

[30] Foreign Application Priority Data

Dec. 21, 1995 [FR] France ..... 95 15305

[51] Int. Cl.[7] ..... B22D 11/06

[52] U.S. Cl. ..... 164/428; 164/429; 164/443; 492/6; 492/16; 492/46

[58] Field of Search ..... 164/428, 429, 164/435, 448, 442, 443; 492/2, 6, 7, 16, 46

[56] References Cited

U.S. PATENT DOCUMENTS

| | | | |
|---|---|---|---|
| 4,864,703 | 9/1989 | Biondetti et al. | 492/16 |
| 5,010,633 | 4/1991 | Brown et al. | 492/46 X |
| 5,140,731 | 8/1992 | Brendel | 492/7 |
| 5,383,833 | 1/1995 | Brugger et al. | 492/46 X |

FOREIGN PATENT DOCUMENTS

| | | |
|---|---|---|
| 0 237 008 | 9/1987 | European Pat. Off. . |
| 2 572 313 | 5/1986 | France . |
| 38 01 085 | 7/1989 | Germany . |
| 42 02 373 | 4/1993 | Germany . |
| 93 06 449 | 9/1993 | Germany . |
| 42 27 987 | 2/1994 | Germany . |

OTHER PUBLICATIONS

Morel, M. et al: "Shaperoll Actuator–Results of Hot and Cold Mill Applications", Iron and Steel Engineer, vol. 69, No. 4, Apr. 1, 1992, pp. 74–77.

*Primary Examiner*—J. Reed Batten, Jr.
*Attorney, Agent, or Firm*—Arent Fox Kintner; Plotkin & Kahn, PLLC

[57] ABSTRACT

The device for the making a flat product (P) comprises a cylindrical wall, brought into rotation around a fixed core (1) and cooled by circulation of a fluid for the formation, of the flat product (P), onto an angular sector of the wall (2). The cooled wall on which is cast the metal is made up of a thin metal envelope forming a shell (2) simply inserted with possibility of sliding onto a circular surface (11) of the fixed core which constitute the central section of a fixed shaft (1) to hold and center the shell (2), the shaft (1) being connected with a thrust device allowing application of the shell (2) on the circular surface (11) of the shaft (1), the cooling fluid providing the lubrication of the bush thus made.

21 Claims, 6 Drawing Sheets

ROTARY CONTINUOUS CASTING DEVICE

This invention relates to a rotary device for continuous casting of liquid metal, usable specifically for continuous production of thin slabs or ferrous or non-ferrous metal strips.

Continuous casting of steel or other metal is performed, in a conventional way, in a mould whose walls are cooled strongly, at the contact of which the cast metal solidifies in surface in order to constitute a product limited by a hardened crust surrounding a liquid or pasty core and, with a cross section identical to that of the mould. This product is removed from the mould at a certain speed and is then picked up by guiding devices fitted with cooling means up to complete solidification. One can thus make products of various sections, such as bars or slabs, with a width much greater than their thickness.

Conventional continuous casting installations using, particularly, an oscillating ingot mould, are designed for producing slabs whose thickness does not normally fall below 80 to 100 mm. It is thus normally necessary to use special machines for the production of thin slabs, less than 80 mm in thickness.

It is an objective since some years to make, according to a continuous process, products still thinner, constituting simple strips whose thickness can be as small as 1 mm approximately, in certain cases.

For this purpose, one can advantageously use rotary machines comprising at least one drum brought into rotation around its axis and limited by a cooled cylindrical wall along which the cast metal solidifies to form a strip which is then separated from the drum (EP-A-237 008).

However such arrangement is used only for the casting of amorphous metals or metals with a relatively low melting temperature. In another known arrangement two cylinders with horizontal axes, located opposite to one another in order to provide a gap to the width one wishes to give to the strip are used. The metal is cast in the space comprised between both cylinders and which has more or less a V-shaped cross section, which is reduced gradually to an outlet gap whose width corresponds to the distance between both cylinders, whereby the casting space is limited, axially, by end plates applied more or less tightly on both cylinders.

Each cylinder is cooled strongly by water circulation and the cast metal solidifies along the circumference of both cylinders which are brought into rotation in the reverse direction, in order to form a product which has solidified at least superficially and which is ejected towards secondary guiding and cooling means placed below both cylinders and in which the solidification and cooling phases are completed.

In a known arrangement disclosed for example in DE-A-3 801 085, the cylindrical wall on which the metal is provided is a drum supported by two bearings defining a rotation axis of the drum and inside which is placed a fixed core limited by a circular surface separated from the inner surface of the drum by an annular gap in which the cooling fluid circulates. For this purpose, the fixed core is provided with two chambers respectively a feeding chamber and an exhaust chamber leading to each side to a sealing gasket which extends along a generatrix between the rotary wall and the fixed core. The cooling fluid introduced by the feeding chamber penetrates into the annular gap and rotates around the core until the sealing gasket and is exhausted by the exhaust chamber.

To allow distribution of the fluid on the whole drum surface, circulation grooves are provided onto the inner surface of the cylindrical wall which thus must be thick.

Moreover, the drum assembly must be relatively rigid to provide centering of the cylindrical wall onto the rotation axis around the fixed core.

However, the outer surface of the cylindrical wall on which is cast the liquid metal is at a temperature well above that of the inner surface along which circulates the cooling fluid. There is thus relatively important thermal deformation effects bought about by differential expansions. Practically, the outer surface of the wall shows a tendency to vaulting and when two opposite cylinders are used, the metal exit gap is narrower in the central portion thereof than on the edges.

It is difficult to counteract these expansion effects and the means which should be used to this end may exert a negative influence on the solidification conditions and, consequently, the metallurgical quality of the finished product. Besides, the results obtained often remain uncertain.

The purpose of the invention is to overcome these shortcomings thanks to a new arrangement which, with simple and easily maintenance means, enables to compensate efficiently for differential expansions as well as deformations and to improve the quality of the cast product.

Thus said invention relates generally to a rotary device for the making of a flat product by casting a liquid metal on at least a rotary mould driven in rotation around an axis and limited by a revolution cylindrical wall around said axis, having an outer surface and an inner surface and surrounding a fixed core limited by a circular surface centred on the axis and connected with means to provide a cooling fluid circulation between the inner surface of the wall and the circular surface of the core, the liquid metal being cooled along an angular sector of the outer surface of the rotary cylindrical wall, in order to obtain a flat product at least superficially solidified and distant of the cooled wall along the extraction direction.

According to the invention the cooled wall on which the metal is cast is made of a thin cylindrical envelope forming a shell simply inserted on the circular surface of the fixed core which provides the central section of a fixed shaft to hold and center said shell said circular surface having a radius substantially equal, down to the assembly clearance, to that of the inner surface of the cooled wall and covering an angular sector corresponding at least to the angular sector of the shell on which the metal is cooled and the said fixed shaft is connected to thrust load application means on the inner surface of the shell according to a direction opposite to the metal cooling sector for the application of the shell onto said circular surface of the shaft with interposition of a cooling fluid layer in order to provide a fixed bush for the centering of the shell onto the shaft, the cooling fluid providing lubrication of said bush.

According to a preferred embodiment, the thrust load application means onto the shell comprises at least a pad having an outer surface covering a circular sector of radius substantially equal to that of the inner surface of the shell and opposite to the circular surface of the shaft and said pad is sliding mounted onto the shaft according to a direction passing through the axis and is connected at least to a thrust means such as a jack bearing on a side onto the shaft and on the other side onto the pad to push said latter on the side opposite to the circular surface of the shaft on which is applied the shell, a cooling fluid layer being interposed between the inner surface of the shell and the outer surface of the pad which thus provides a radially moveable bush co-operating with the fixed bush made by the circular surface of the fixed shaft for centering the shell.

According to another essential feature, the device comprises means to adjust the load exerted by each jack on the corresponding pad in order to determine an application load of the shell on the shaft liable to compensate for the deformation of the shell further to the differential expansions between the inner surface and the outer surface of the former.

Preferably, one uses to this end at least two pads located one close to another over the length of the shell and associated with separate individual adjustment means of the thrust load exerted by each of the pads on the corresponding part of the shell.

Besides, each application surface forming a bush is fitted on the one hand with a plurality of openings distributed over the said surface and linked to at least one pressurised fluid supply system, arranged inside the fixed shaft and, on the other hand, means for collecting the fluid such as openings distributed over the application surface and linked, individually or by groups, to at least one exhaust system arranged inside the fixed shaft.

Advantageously, the fluid supply openings and the collection means are arranged, respectively, in several zones provided over the width of the shell and distributed so that the fluid circulation between each supply opening and a corresponding collection means ensures uniform cooling of the shell along the application surface. Besides, the supply openings of each zone are advantageously linked to a separate supply system fitted with individual means for the adjustment of the pressure of the fluid at the outlet of the said system.

According to a preferred embodiment, the collection means arranged on each application surface forming a bush of the shell comprise at least one groove covering at least one sector of the said bush and in which arrives at least one exhaust opening linked by a channel to a fluid exhaust system arranged inside the fixed shaft.

According to another essential feature, the central portion of the fixed shaft in which is provided the application circular surface of the shell is fitted with a recess inside which is inserted at least an application pad of the shell, said recess being limited, axially, by two side flanges for holding the pad and, on the side of the shaft's axis, by a plane surface in which is arranged at least one protruding section threading into a corresponding bore of the pad, whereas the said protruding section and the corresponding bore provide, respectively, the piston and the body of a thrust jack for the pad.

One should note that the fixed application surface arranged on the shaft on the side of the casting may advantageously exhibit a profile which may not be strictly cylindrical and liable to compensate for the foreseeable deformation of the shell when in operation.

Since the shell is rotary mounted on a fixed shaft, it is possible to place inside the said shaft not only the cooling fluid supply and exhaust systems, but also all the useful devices such as means for metal mixing, electromagnetic or ultrasound-operated, which can be accommodated inside the fixed shaft.

Besides, the shell is maintained axially, at both its side ends, by two circular flanges rotary mounted on the fixed shaft, each via a bearing and fitted with sealing joints working together with corresponding parts of the fixed shaft.

This configuration enables to bring into rotation, the shell which is linked in rotation with at least one of the end flanges by means enabling differential expansions, whereby the said flange is kinetically bound to a rotation control means carried by the shaft.

But the invention can be better understood by the following description of a particular embodiment, given for exemplification purposes and represented on the appended drawings.

Figure 1:
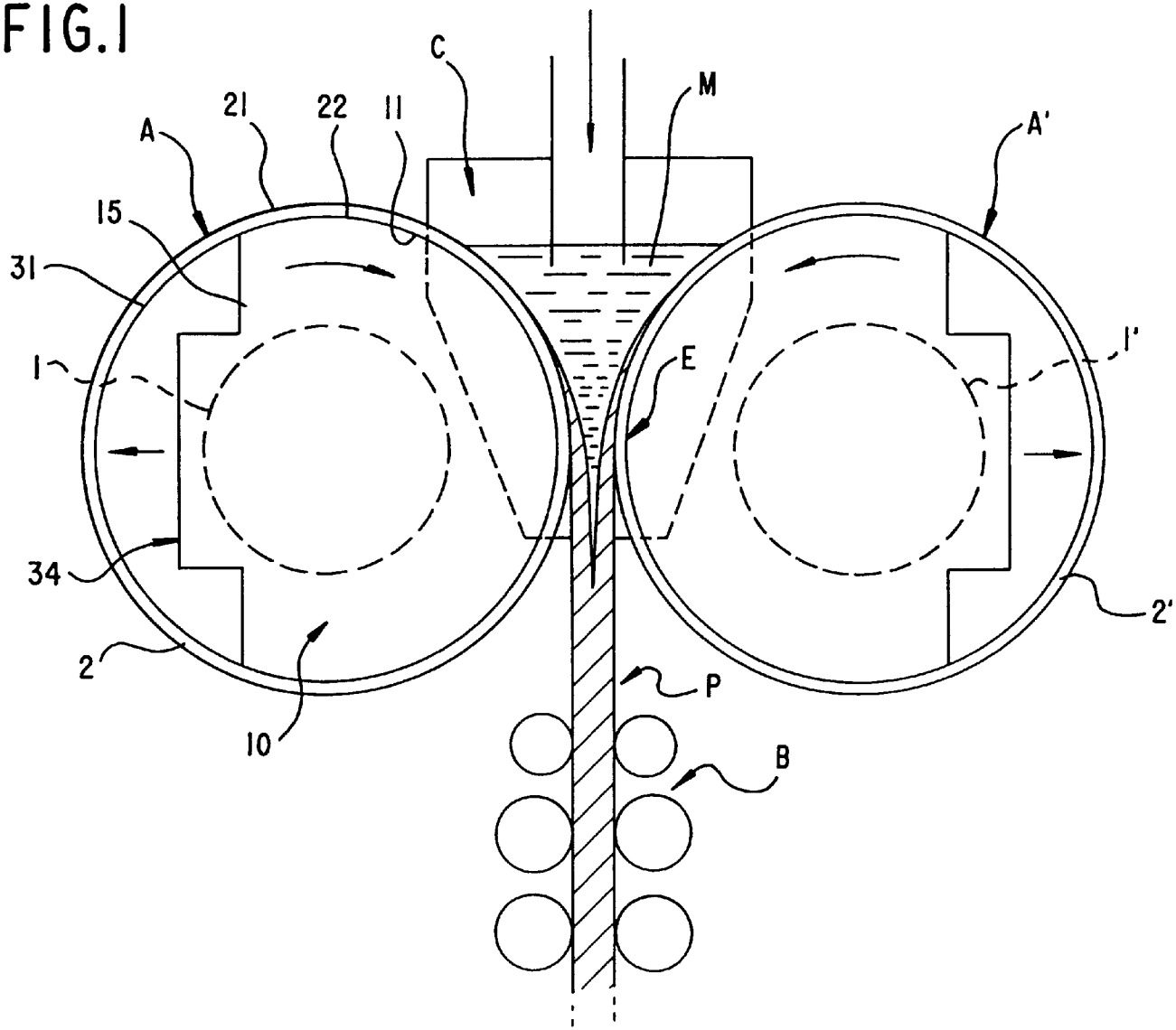
FIG. 1 is a diagrammatical view of a casting machine fitted with rotary cylinders.

FIG. 1 is a diagrammatical representation of a casting machine fitted with rotary cylinders, comprising two cylinders A, A' brought into rotation in reverse direction and limiting a V-shaped space in which a liquid metal M is cast. This casting space is limited laterally by partitions C applied on the sides of the cylinders A, A' under a pressure just sufficient to guarantee tightness without disturbing the rotation.

The outer wall of each cylinder A, A' is cooled strongly by circulation of the fluid and thus, along both cylinders A, A' two solidified crusts are built, converging towards one another in order to limit a product P with thickness equal to the width of the gap E and whose core can be liquid, whereas the complete solidification is carried out in a secondary extraction and cooling device B.

The invention relates to the embodiment of a rotary cylinder such as represented in FIGS. 2 to 11. A casting machine of the type represented in FIG. 1 can thus be constituted of two cylinders according to the invention.

As schematically shown in FIG. 1, each cast cylinder A, A' comprises a thin cylindrical envelope having an outer surface 21 and an inner surface 22 and providing a shell 2 inserted onto a core 10 limited by a cylindrical circular surface 11 having a radius substantially equal to that of the inner surface of the shell 2.

Figure 2:
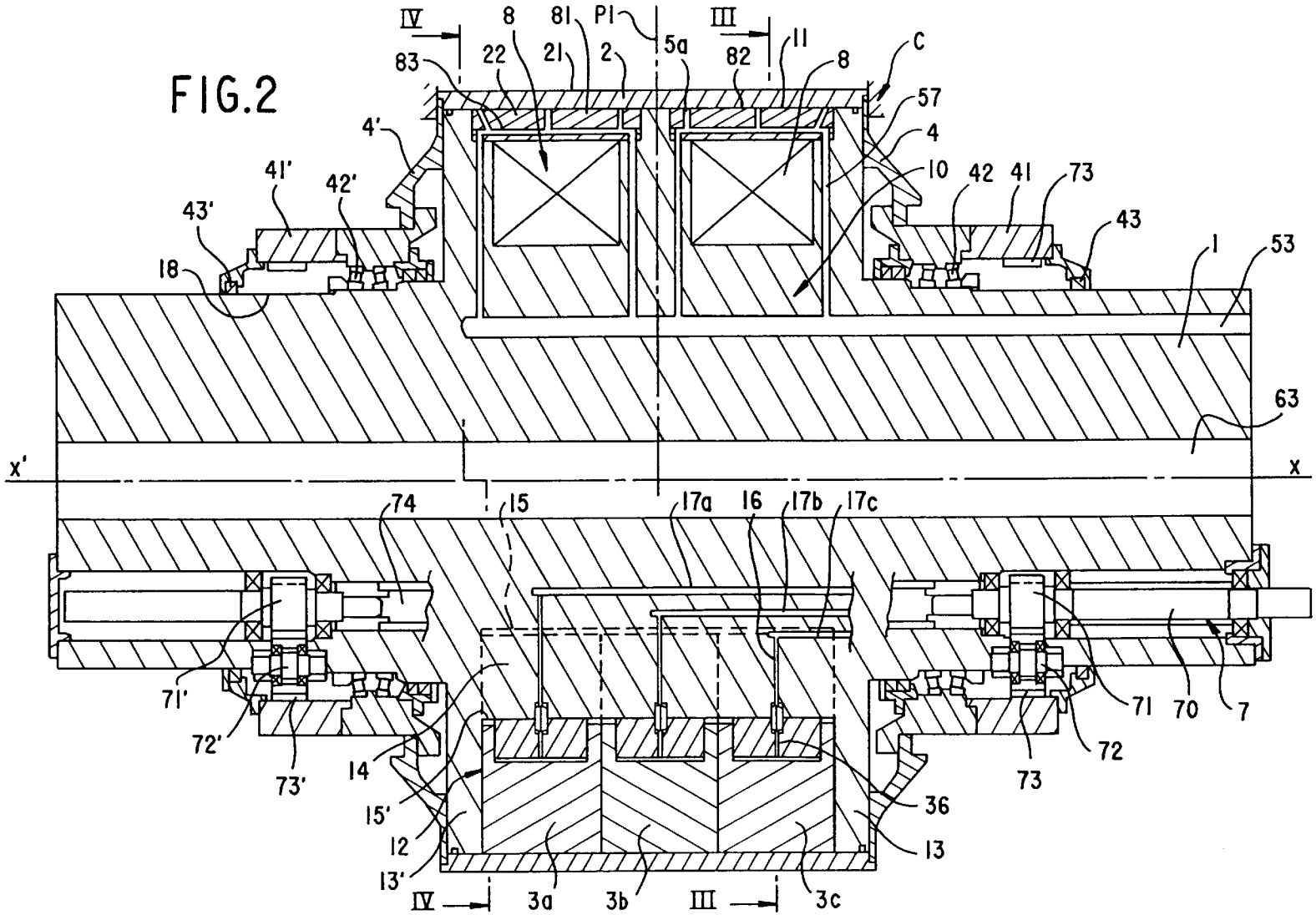
FIG. 2 is an axial section of the whole rotary cylinder according to the invention.
Figure 3:
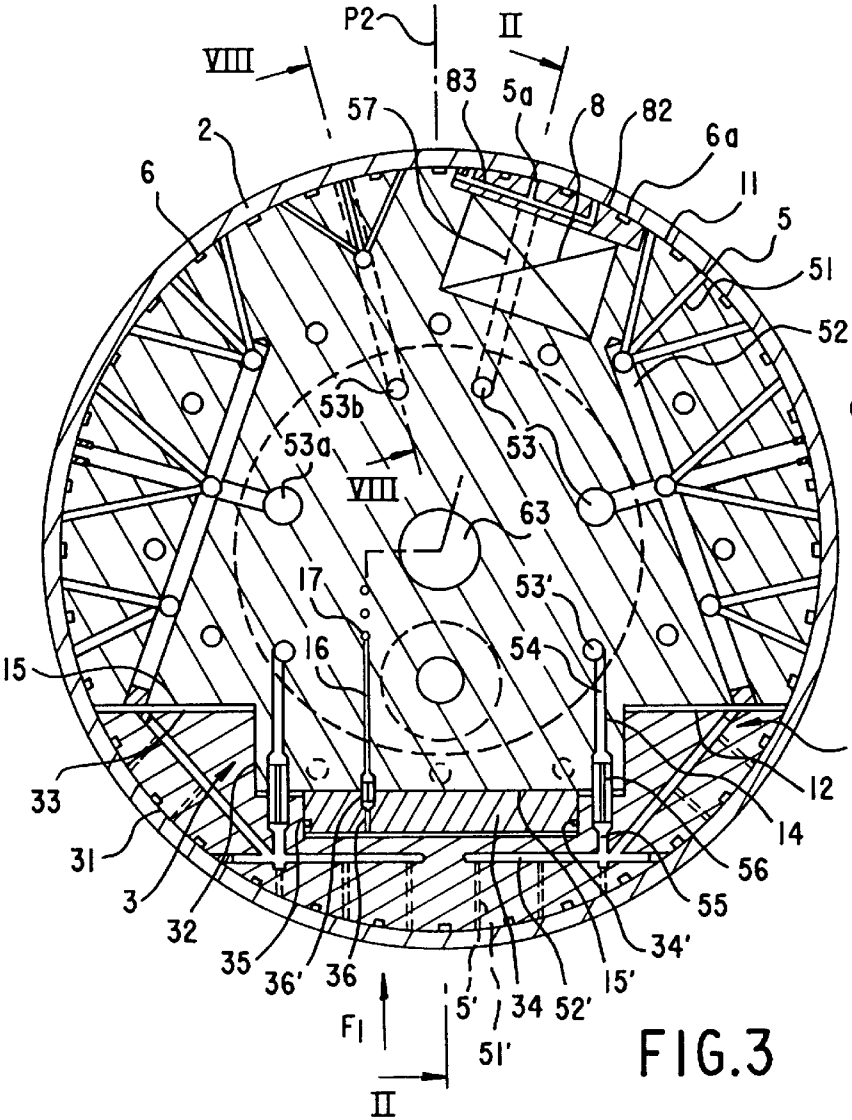
Figure 5:
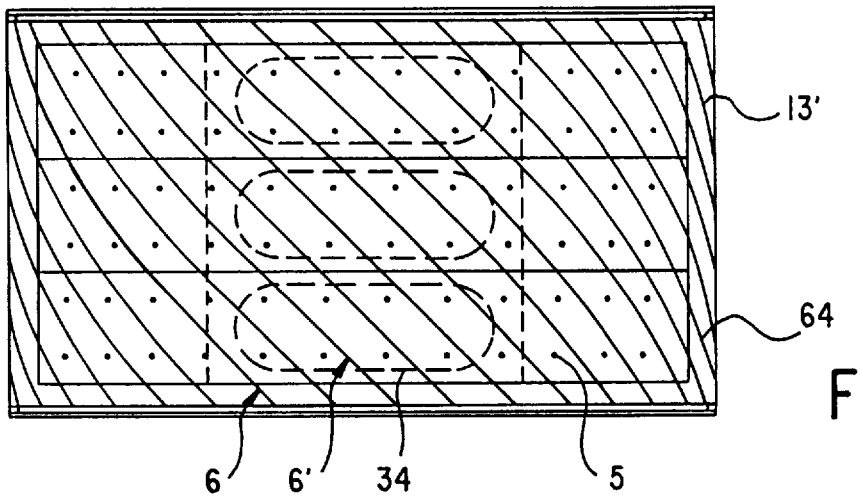
FIG. 5 is a view from beneath along the arrow F1 of FIG. 3, whereas the shell has been removed.
Figure 6:
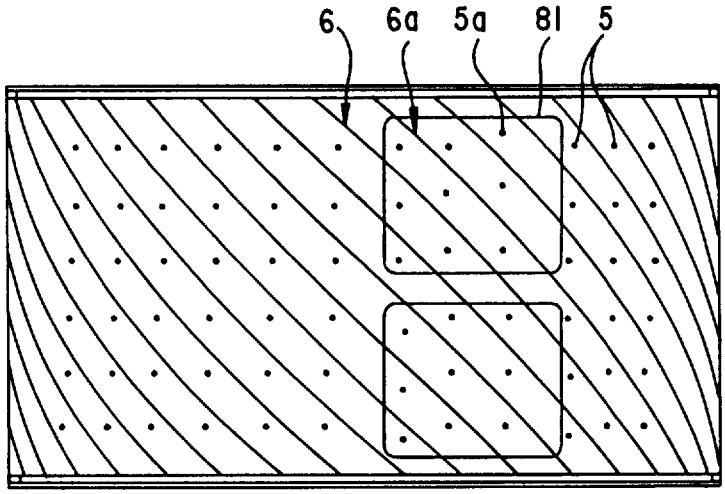
FIG. 6 is a view from above along the arrow F2 of FIG. 4, whereas the shell has been removed.

As shown particularly in FIG. 2 which shows the whole device in axial section according to line II—II of FIG. 3, the core 10 provides the central widened section of a fixed shaft 1 to hold and center the shell 2, said latter being simply inserted on the cylindrical surface 11 and axially hold with a possible radial gap by two circular flanges 4, 4' mounted in rotation onto the shaft 1 on either side of the widened section 10 by means of bearings 42, 42'.

The outer circular surface 11 of the shaft 1 covers, a cylindrical revolution sector at least of 180° centred on the axis x'x of the shell 2 and is extended by a circular surface provided on a moveable pad 3 connected to the shaft 1. The circular surface 11 has also a diameter substantially equal to that of the inner surface 22 of the shell and covers, preferably, the peripheral complementary sector such that the widened section provides with the pad 3 after the assembly a complete cylinder on which is inserted the shell 2 whose axis x'x is coincident with that of said cylinder 11, 31.

Figure 4:
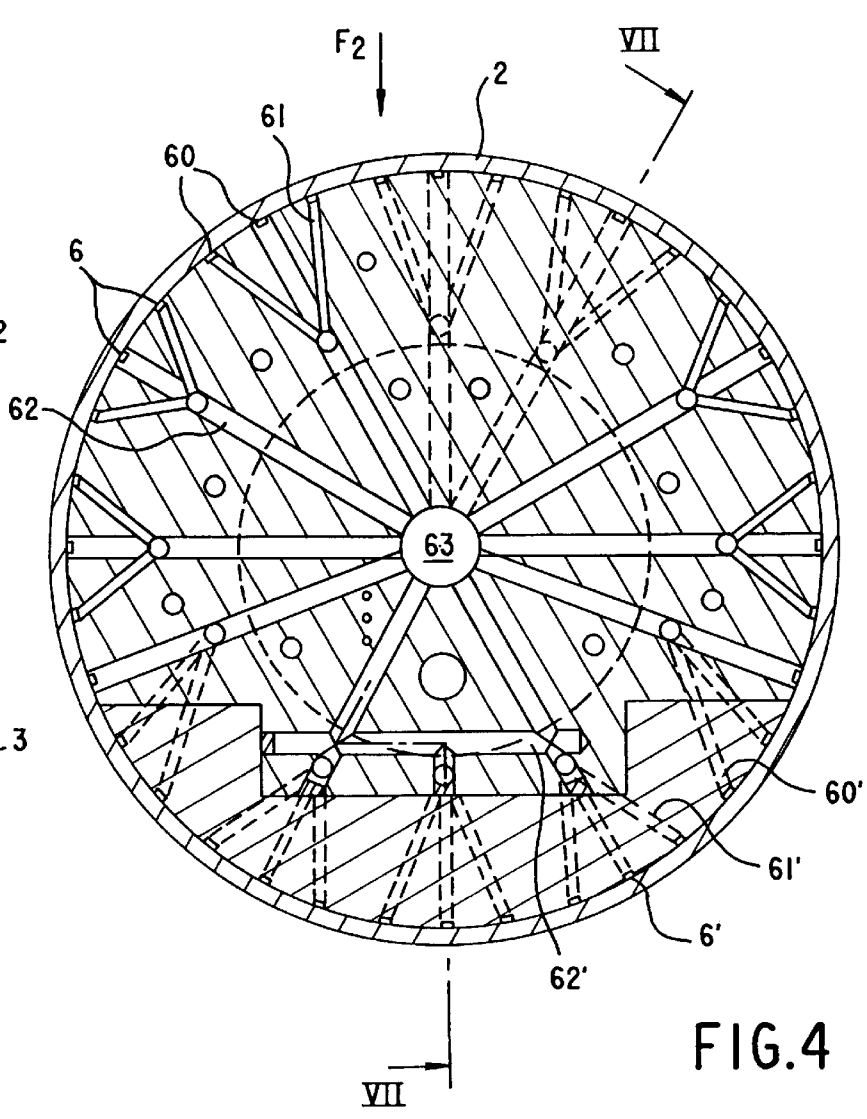
FIG. 3 and FIG. 4 are transversal cross sections respectively along the line III—III and the line IV—IV of FIG. 2.

Preferably, as shown in FIG. 2, the widened section 10 of the shaft 1 is provided on the side opposite to the core sector, with a transversal recess 12 centred on the middle plane P1 perpendicular to the axis x'x and covering a length somehow shorter than that of the widened section 10 in order to leave two circular side flanges 13, 13' at the ends of the said widened section. Moreover, the bottom of the recess 12 has a ribbed profile comprising a central protruding part 14 surrounded by two half-flats 15, as shown in FIGS. 3 and 4.

Inside the recess 12 which is closed, externally, by the shell 2, is placed at least one pad 3 whose transversal section has the overall shape of a crescent limited on one side by an outer surface 31 with a radius equal to that of the cylindrical surface 11 of the widened section 10, and on the other side by an inner surface 32 exhibiting a ribbed profile matching that in the bottom of the recess 12 and comprising a groove 32 forming a recess in which can penetrate the protruding section 14 as well as two lateral surfaces 33 arranged respectively opposite the half-flats 15 of the widened section 10.

In the preferred embodiment represented in the figures, one uses several adjoining pads, for example three pads 3*a,* 3*b,* 3*c* in order to distribute the loads applied, in the way stated below.

During assembly, one can thus place on the protruding section 14, the three pads 3*a,* 3*b,* 3*c* occupying the recess 12 between both flanges 4, 4', then thread the shell 2 onto the assembly. The pads 3 are then maintained inside the recess 12, in the axial direction by the flanges 13, 13', in the radial direction by the shell 2 and the bottom 15 of the recess and in the direction transversal to the axis by the protruding section 14, whereas the pads are centred on the longitudinal plane P2 passing through the axis x'x of the shaft.

Besides, the radial position of each pad 3 with respect to the axis x'x can be adjusted thanks to at least one jack interposed between each pad 3 and the shaft 1 and comprising a piston 34 bearing on the end surface 15' of the protruding section 14 and penetrating in a corresponding bore 35 arranged in the bottom of the housing 32 of the pad 3.

The former has an oblong rectangular shape, especially if we use several pads and it is particularly advantageous to associate each pad 3*a,* 3*b,* 3*c* to a single jack of oblong section covering almost the whole surface of the bottom 32 of the groove, but showing semi-circular ends, as represented in the figures. However, one could also use several jacks of a circular section, placed one near another.

In the preferred embodiment represented in the figures, the piston 34 is an independent plate lodged in the bore 35 and which bears simply on the end surface 15', whereas a peripheral joint 34' ensures the tightness of the jack chamber thus constituted. This chamber can be supplied with oil by a channel 36 going through the plate 34 and linked by a flexible joint 36' to the end of a channel 16 drilled in the protruding section 14 and ending in a supply conduit 17.

As can be seen in FIG. 2, each of the pads 3*a,* 3*b,* 3*c* is associated with a jack supplied by a separate system 17*a,* 17*b,* 17*c* so that it is possible to act individually on the radial position of each of the three pads.

Figure 7:
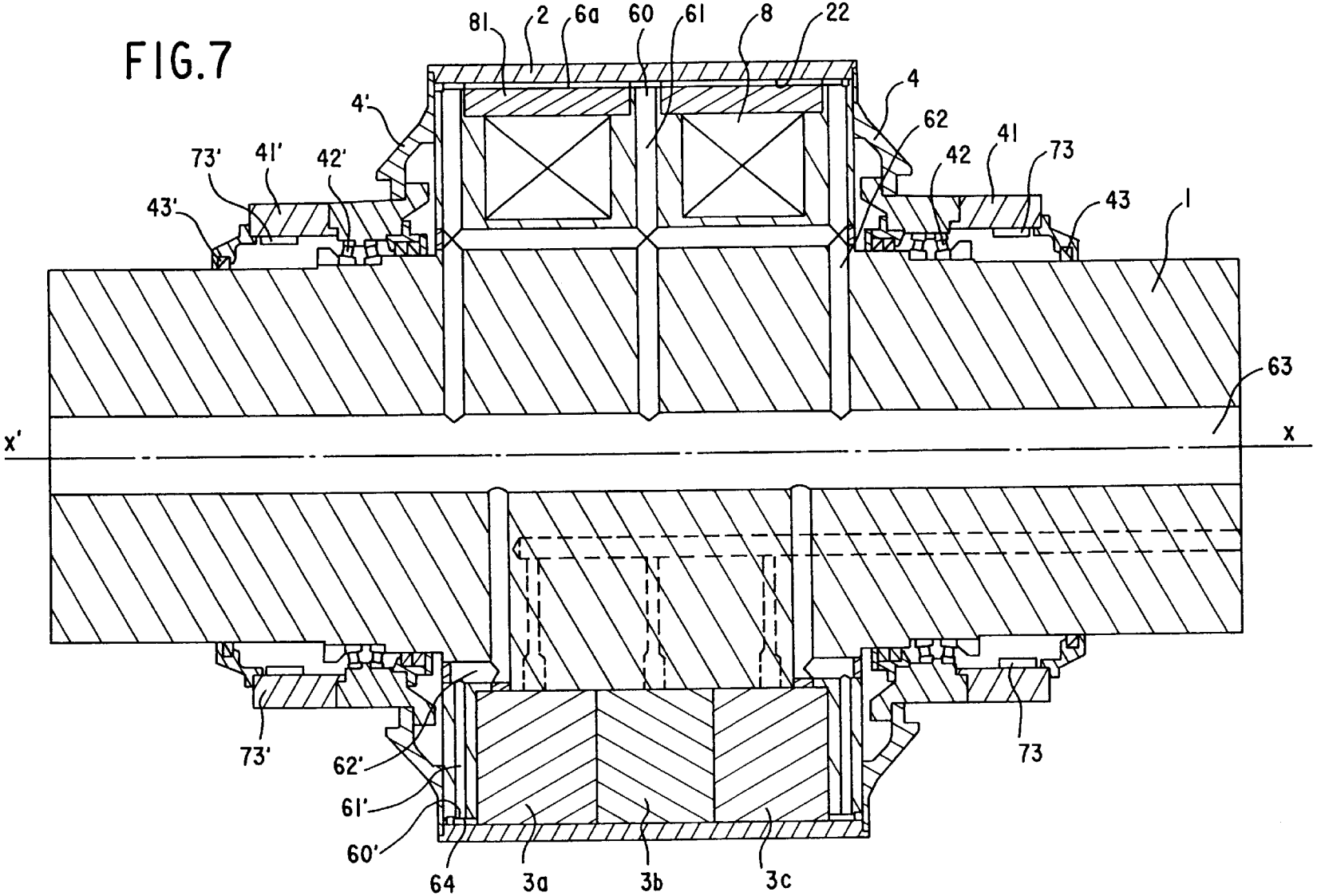
FIG. 7 is an axial section along the line VII—VII of FIG. 4.

As explained above, the shaft 1 is fixed in rotation and the shell 2 is rotary mounted around the shaft while sliding over the cylindrical extension 11 arranged on the periphery of the widened section 10 and extended by the outer surfaces 31 of the three pads 3*a,* 3*b,* 3*c*. To this end, as shown in FIGS. 2 and 7, the shell 2 is brought into rotation by two circular flanges 4, 4' fixed respectively on two rings 41, 41' rotary mounted, via roller bearings 42, 42' and axial stops 43, 43' on cylindrical extensions 18 arranged on either side of the widened section 11 of the shaft 1 and centred on the axis x'x of the shaft.

The flanges 4, 4' are brought into rotation in the way described further.

In order to enable frictionless sliding of the shell 2, it is necessary to interpose a lubricating fluid film between the inner surface 22 of the shell and the cylindrical extension 11, 31 fixed in rotation. Thus, the shell 2 rotates on at least two bushes constituted respectively by the cylindrical surfaces 11 of the shaft 1 and 31 of the pads 3.

As shown in FIG. 1, in case when two rotary cylinders A, A' are used according to the invention, the middle plane P2 on which are centred the pads is a horizontal plane passing through the axes of both cylinders A, A'.

The pads are thus directed to the side opposite the liquid metal and the sector of the shell 2 turned towards the casting cavity is applied onto the surface 11 by the load exerted on the other side of the shaft 1 by the pads 3 under the effect of the jacks 34.

It follows that the profile of the shell 2 in the section in contact with the metal is determined by that of the surface 11 and does not risk to be deformed under the effect of expansions.

Besides, according to another essential features of the invention, the lubrication fluid can also ensure the cooling of the shell.

The nature and the characteristics of this fluid will then be selected in order to fulfil both functions: lubrication as well as cooling. However, it is especially economical and advantageous to use water to this end.

This fluid is injected between the opposite surfaces 22 and 11, via a large number of openings 5 regularly distributed over the whole application surface 11 and located at the outlet of channels 51 arranged in bundles and linked by groups to collectors 52 ending themselves into supply conduits 53 parallel to the axis x'x of the shaft 1.

As shown in FIGS. 3 to 6, the openings 5 can be arranged, in square or in quincunx, on rows parallel to the axis x'x and these rows are linked by groups to the various collectors 52. Each collector 52 thus covers a determined zone of the shaft 1 and the corresponding ducts 53 can be supplied under pressure and flow rates adapted to the position of the corresponding sector of the shaft, in relation to the casting conditions.

The different ducts 51, 52, 53 are drilled inside the fixed shaft 1 and from the widened section 10 and are distributed in a way which allows not to weaken the mechanical resistance of the assembly, for instance in the way represented in FIGS. 2 and 7.

The outer surface 31 of each pad 3 is supplied with fluid in an analogous way by openings 5' regularly spaced and linked by channels 51' to collectors 52'.

However, in order to enable slight position adjustments of each pad 3 with respect to the shaft 1, each collector 52' is linked to a fluid supply duct 53' by two channels 54, 55, arranged in an alignment one to another, respectively in the protruding section 14 and in the pad 3 and linked one to another by a junction device liable to follow light displacements of the pad 3 and constituted, for example, of a socket 56 drilled axially and fitted at its ends with tight joints, articulated to slide into corresponding bores arranged at the outlet of two channels 54, 55.

The cooling fluid, generally water, is injected under pressure into the different supply ducts 53, 53'. It is distributed in the collectors 52, 52' and is injected through the openings 5, 5' which are equidistant over the whole application surface 11 of the shaft 1. The fluid thus spreads between the opposite surfaces 11 of the fixed shaft 1 and 22 of the shell 2. However, the path followed by each quantity of fluid injected is rather short since the application surface 11 is fitted with collection means 6 regularly spaced over its whole surface and advantageously constituted of a number of equidistant helicoidal grooves 6 in order to pass between the rows of openings 5 and which are linked to an exhaust system 63.

For instance, as can be seen in FIGS. 4 and 7, the grooves 6 can be fitted with spaced openings 60 connected to channels 61 linked as bundles to collectors 62 leading to an exhaust duct 63 which can be made of a single duct, of a rather large diameter, arranged in the axis of the shaft 1.

Each pad 3 is also fitted with helicoidal grooves 6' extending in the alignment of the corresponding grooves 6 of the application surface 11. At the ends 64 of these grooves placed at the level of the flanges 13, 13' have been arranged lateral openings 60' which are connected to collectors 62' by channels 61' arranged in both flanges 13, 13' (FIG. 7).

Thanks to these arrangements, it is possible to inject under pressure, via the openings 5, a large quantity of water which spreads as a thin layer between the application surface 11 of the shaft and the inner surface 21 of the shell and collects rapidly in the grooves 6, 6' to be ejected through the central duct 63. Because of the great number of injection openings 5 arranged on the application surface 11, the water injected under pressure spreads uniformly over its whole surface and enables frictionless rotation of the shell 2 as a fluid bearing. Besides, the heat applied from the outside onto the shell 2 is immediately absorbed by the water film thus produced. This film is very thin, but further to the distribution of the grooves 6, 6' passing between the openings 5, 5', each water molecule is ejected rapidly after a very short path on the application surface 11 and the whole quantity of heat thus rejected can be quite important.

Obviously, the conditions prevailing to the injection of the fluid must be adjusted, such as the flow rate and the pressure, in order to take into account both functions of the fluid. The pressure is determined in relation to the application load of the shell 2 on the shaft 1, which is exerted by the pads 3 and the flow rate must be maintained at sufficient level to guarantee the cooling of the metal via the shell 2.

Figure 8:
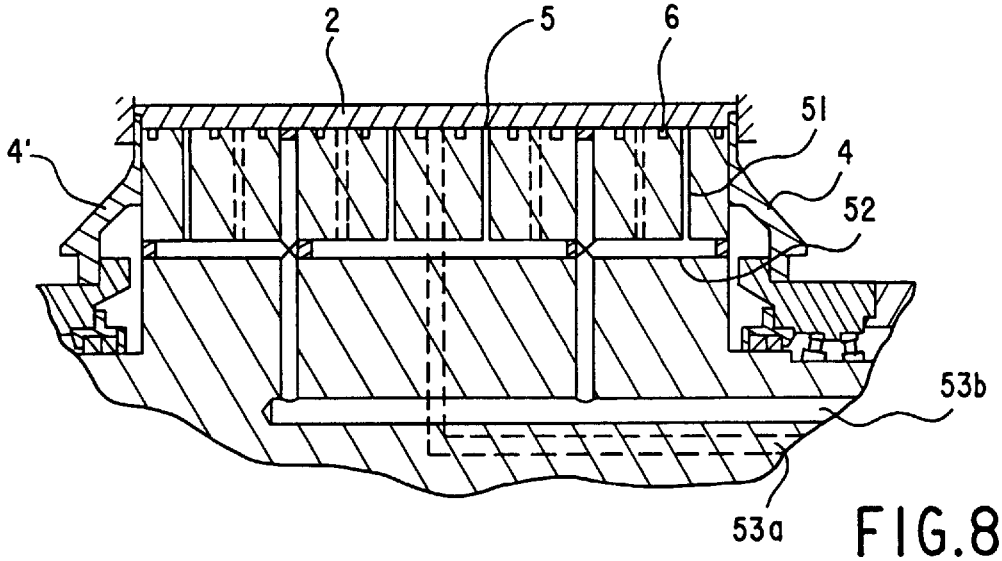
FIG. 8 is a partial view of an axial section along the line VIII—VIII of FIG. 3.

One should note that, as shown in FIG. 8, the supply openings 5 are advantageously regrouped by zones connected to separate supply systems 53*a* and 53*b* and associated with individual adjustment means for the pressure and the flow rate of the fluid injected into each zone. The distribution of the openings and the distribution of the fluid thus enable to produce uniform cooling and/or to adjust the action of cooling and of fluid bearing at the position of the corresponding zone in the casting cavity.

As shown in FIG. 2, to ensure the rotation of the shell 2, both flanges 4, 4' are driven in synchronism around the axis x'x by a mechanism 7 mounted on the fixed shaft 1 and comprising a driving shaft 70 connected to a motor, which is not represented. Each of both flanges 4, 4' is associated with a toothed crown 73, 73' driven by a driving pinion 71, 71', via a mounted idle pinion 72, 72'. One of the driving pinions 71 is fixed by wedges on the driving shaft 70 and the other driving pinion 71' is driven by an extension 74 passing through a bore in the shaft 1 and fitted at its ends with articulated coupling joints with both pinions 71, 71'.

Figure 9:
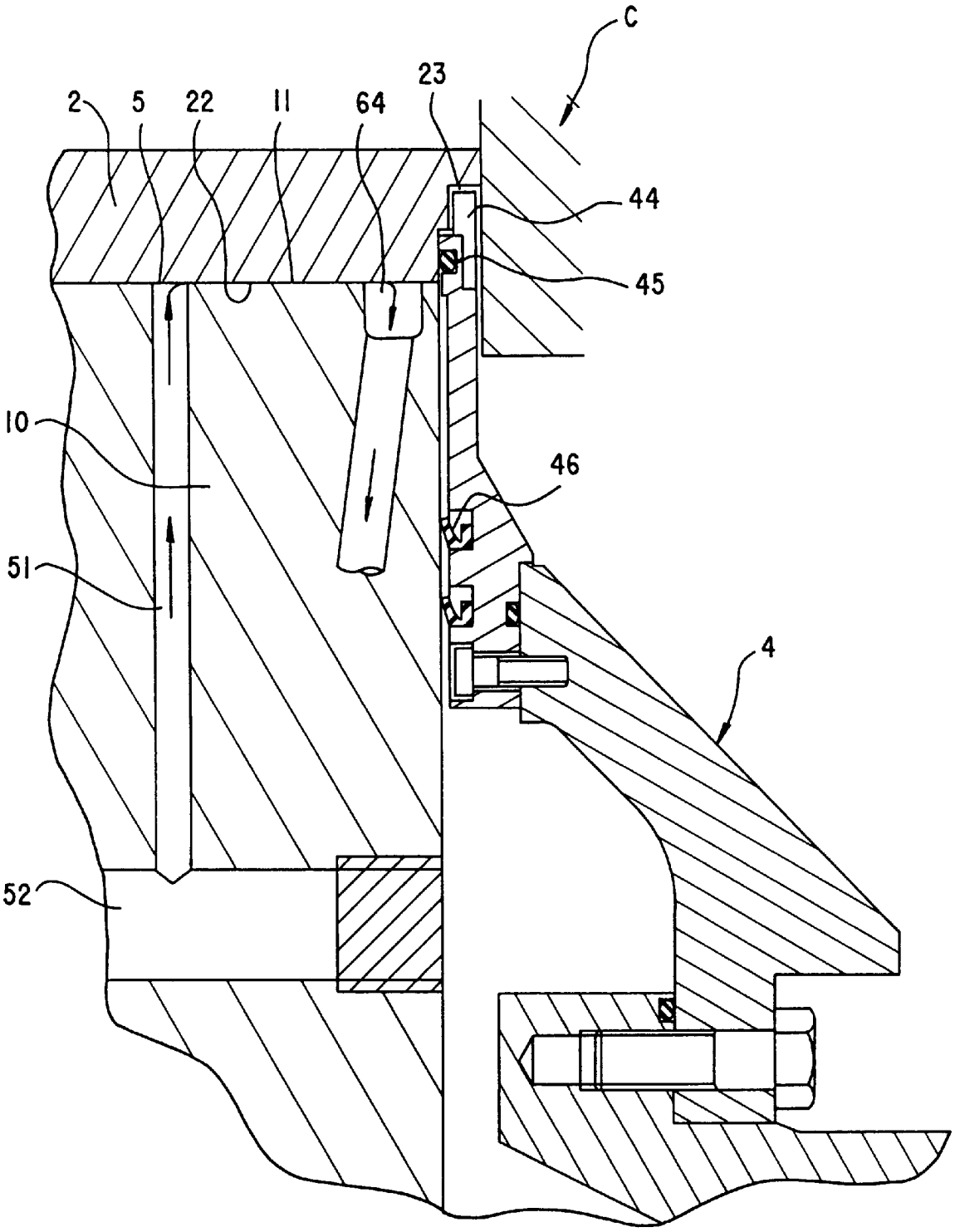
FIG. 9 is a detailed view of an axial section along the line IX—IX of FIG. 3.

As shown in FIG. 9, each circular flange 4, 4' is fitted, on its periphery, with indented sections 44 engaging into corresponding recesses 23 arranged on the lateral ends of the shell 2, while leaving the necessary clearance for expansions.

On the other hand, the application surface 11 is fitted, at each end, with a circular groove 64 which collects the surplus of fluid in order to eject it towards the central duct 63. To avoid leaks, a sealing ring 45 is accommodated in a peripheral groove of each flange 4 and applied on the corresponding lateral side of the shell 2.

Moreover, one or several annular joints 46 are placed in circular grooves of each flange 4, 4' and comprise a friction section 46' bearing on the lateral side of the part 10 of the fixed shaft 1, in order to avoid water leaks to the inside which might corrode the bearings 42 as well as the driving mechanisms.

Besides, FIG. 9 is a diagrammatical view of a lateral partition C limiting the casting space of the metal and which is applied to the side of the shell 2 with a pressure just sufficient to guarantee the tightness of the casting cavity without disturbing the rotation of the shell 2. One should note that the former is not subject to any other load, thanks to the clearances left, in the radial as well as in the longitudinal directions, between the driving identations 44 and the corresponding recesses 23 of the shell.

With respect to the dispositions known previously, the invention exhibits multiple advantages.

First of all, the deformations of the shell are quite limited since it is made of a thin envelope applied onto a fixed cylindrical extension by the opposite pads 3. These pads are supplied by separate systems and can thus be adjusted individually in order to control the deformations of the shell resulting from expansions. The shell 2 thus takes the shape of the cylindrical extension 11 of the side of the casting opposite the pads 3. The application surface 11 may not be perfectly cylindrical but, on the contrary, exhibit a slightly curved profile, in a way enabling to compensate for the foreseeable deformation of the shell during operation under the effect of expansions.

As we have already seen, it is possible to use several adjacent pads 3*a*, 3*b*, 3*c* adjusted individually in order to distribute the application load of the shell on the shaft 1.

Besides, the configuration of the device is relatively simple since the sole moveable part is comprised of the shell 2 and of both flanges 4, 4' and since the assembly is mounted on a fixed shaft in which one can, without any special difficulty, arrange all the supply and exhaust systems for the cooling fluid as well as the hydraulic systems 17 of the pads and the driving mechanisms 7 to rotate the shell 2.

As represented in the various figures, these fixed supply and exhaust systems can be distributed inside the mass of the fixed shaft 1 in order not to weaken the shaft and, on the other hand, to circumvent, if needed, the application pads 3, as shown notably in FIG. 7.

Moreover, according to another advantageous embodiment of the invention, the use of a fixed shaft fitted with a widened section 10 enables incorporating inside the said shaft certain accessory devices.

Especially, as indicated in FIGS. 3 and 4, it is well-advised to accommodate in the sector of the shaft 1 directed to the liquid, metal mixing means 8 such as electromagnetic coils or an ultrasound transmitter.

Such a device can be advantageously located in a housing arranged in the widened section 10 and covered with a cap 81 with a circular surface 82 and placed in the alignment of the outer surface 11 and in which have been arranged channels 83 connected to the outside by openings 5*a* distributed in the same way as the openings 5 of the outer surface 11 to ensure the continuity of the liquid supply.

To this end, the channels 83 are placed in the alignment of channels 57 arranged radially in the widened section 10 and leading either to a collector 52 or directly to a longitudinal supply duct 53.

In the same way, the outer surface 82 of the cap 81 is fitted with helicoidal grooves 6*a* arranged in the alignment of the grooves 6 of the surface 11 of the shaft 1.

Other accessories means could also be adapted to the device according to the invention. Indeed, the said invention is obviously not limited to the details of embodiment previously described for exemplification purposes and could be subject to variations without departing from the scope defined by the claims.

More particularly, we have described the invention in the case of a casting machine of a known type, comprising two rotary cylinders, opposite one another, but the same arrangements could be advantageously used for machines of another type comprising, for instance, a single rotary cylinder, associated with a strip constituting the other wall of the mould.

On the other hand, we have described a particularly suitable embodiment of supply and exhaust systems of the fluid, but other equivalent means could be employed, notably thanks to the use of a fixed shaft.

Besides, it is interesting to use several adjacent pads in order to modulate the application load of the shell, but the installation could be simplified by the use of a single pad associated with one or several jacks.

The reference numbers inserted after the technical features in the claims are used to allow a better understanding of the claims and not to restrict the scope thereof.

We claim:

1. A rotary device for the making of a flat product (P) by casting a liquid metal on at least a rotary mould (A) limited by a revolution cylindrical wall (2) around an axis (x'x) having an outer surface (21) and an inner surface (22) and surrounding a fixed core (1) limited by a circular surface (11) centred on the axis (x'x) and connected with means (5, 6) to provide a cooling fluid circulation between the inner surface (22) of the wall (2) and the circular surface (11) of the core (1), the liquid metal being cooled along an angular sector of the outer surface (21) of the rotary cylindrical wall (2), in order to obtain a flat product (P) at least superficially solidified and distant of the cooled wall (2) along the extraction direction, characterised in that the cooled wall on which the metal is cast is made of a thin cylindrical envelope forming a shell (2) simply inserted on the circular surface (11) of the fixed core which provides the central section of a fixed shaft (1) to hold and center said shell (2), said circular surface (11) having a radius substantially equal, down to the assembly clearance, to that of the inner surface (21) of the wall (2) and covering an angular sector corresponding at least to the angular sector of the shell (2) on which the metal is cooled and in that the shaft (1) is connected to thrust load application means on the inner surface (21) of the shell (2) according to a direction opposite to the metal cooling sector for the application of the shell (2) onto said circular surface (11) of the shaft (1) with interposition of a cooling fluid layer in order to provide a fixed bush for the centering of the shell (2) onto the shaft (1), the cooling fluid providing lubrication of said bush.

2. A rotary device according to claim 1, characterised in that the thrust load application means onto the shell (2) comprises at least a pad (3) having an outer surface (31) covering a circular sector of radius substantially equal to that of the inner surface (21) of the shell (2) and opposite to the circular surface (11) of the shaft (1) and in that said pad (3) is sliding mounted onto the shaft (1) according to a direction passing through the axis (x'x) and is connected at least to a thrust means (34) bearing on a side onto the shaft (1) and on the other side onto the pad (3) to push said latter on the side opposite to the circular surface (11) of the shaft (1) on which is applied the shell (2), a cooling fluid layer being interposed between the inner surface (22) of the shell (2) and the outer surface (31) of pad (3) which thus provides a moveable bush co-operating with the fixed bush made by the circular surface (11) of the fixed shaft for centering the shell (2).

3. A rotary casting device according to claim 2, characterised in that each thrust means includes a jack and that said device further comprises means to adjust the load exerted by each jack (34) on the corresponding pad (3) in order to determine an application load of the shell (2) on the shaft (1) liable to compensate for the deformation of the shell (2) further to the differential expansions between the inner surface (22) and the outer surface (21) of the former.

4. A rotary casting device according to claim 3, characterised in that it comprises at least two pads **(3*a*, 3*b*) located one close to another over the length of the shell (2) and associated with separate individual adjustment means (17*a*, 17*b*) of the thrust load exerted by each of the pads (3*a*, 3*b*) on the corresponding part of the shell (2)**.

5. A rotary casting device according to claim 2, characterised in that both application surfaces, respectively fixed (11) and mobile (31), forming the bushes, are each fitted with a number of openings (5, 5') distributed over each face (11) (31) and linked individually or in groups, to at least one pressurised fluid supply system (53) (53') arranged inside the fixed shaft (1).

6. A rotary casting device according to claim 5, characterised in that both application surfaces forming a bush, respectively fixed (11) and mobile (31), are each fitted with means (6) for collecting the fluid, connected to at least one exhaust system (63) arranged inside the fixed shaft (1).

7. A rotary casting device according to claim 6, characterised in that the means (6) for collecting the fluid comprise a number of openings (60, 60') distributed over the application surface (11, 31) and linked, individually or in groups, to at least one exhaust system (62, 63).

8. A rotary casting device according to claim 6, characterised in that the fluid supply openings (5) are arranged in several zones provided over the width of the casting cavity and distributed in such a way that the fluid circulation between each supply opening (5) and the corresponding collection means (6), ensures the cooling of the product cast along the shell (2).

9. A rotary casting device according to claim 8, characterised in that the supply openings (5) of each zone are linked to a separate supply system **(53*a*, 53*b*)** fitted with individual means for the adjustment of the pressure and of the flow rate of the fluid injected into each zone.

10. A rotary casting device according to claim 7, characterised in that the collection means arranged on each application surface (11, 31) forming a bush of the shell (2) comprise at least one groove (6) covering at least one sector of the said bush and in which arrives at least one exhaust opening (60) linked by a channel (61) to a fluid exhaust duct (63) arranged inside the fixed shaft (1).

11. A rotary casting device according to claim 2, characterised in that the circular surface (31) of pad (3) extends axially over at least a section of the length of the shell (2) and covers an angular sector less than 180° and in that the circular surface (11) of the shaft (1) covers an additional angular sector in order to provide with the circular surface (31) of the pad (3), a cylindrical surface covering the whole circumference on which is inserted the shell (2).

12. A rotary casting device according to claim 11, characterised in that the application surface (11) of the shell (2) is arranged on a widened section (10) of the shaft (1) and that the said widened section is fitted, on the side opposite to the metal cast, with a recess (12) inside which is lodged at least one pad (3) for the application of the shell (2), whose outer surface (31) constitutes a moveable bush.

13. A rotary casting device according to claim 12, characterised in that the recess (12) arranged in the fixed shaft (1)

is limited, axially, by two side flanges (13, 13') for retaining the pad (3) and, in the radial direction, by a bearing surface (15) in which has been arranged at least one protruding section (14) threading into a corresponding housing (32) of the pad, whereas each protruding section (14) and the corresponding housing (32) constitute guiding means for the pad along a radial direction, perpendicular to the axis (x', x).

14. A rotary casting device according to claim 13, characterised in that each thrust means includes a jack, and that each pad (3) is associated at least one jack comprising a piston (34) bearing on the end surface (15') of the protruding section (14) and mounted to slide tightly into a bore (35) arranged in the bottom of the housing (32) of the pad (3).

15. A rotary casting device according to claim 14, characterised in that each pad (3) has an oblong rectangular profile and is associated with a single jack, whereas the piston (34) and the bore (35) show an oblong section with rounded ends in order to cover the largest portion of the bottom of the housing (32) with a rectangular section.

16. A rotary casting device according to claim 14, characterised in that the piston (34) is made of an independent plate bearing on the end surface (15') of the protruding section (14).

17. A rotary casting device according to claim 1, characterised in that the fixed application surface (11) arranged on the shaft (1) on the casting side has a profile which may not be strictly cylindrical, liable to compensate for the foreseeable deformation of the shell (2) during operation.

18. A rotary casting device according to claim 1, characterised in that it comprises accessories means (8) housed inside the fixed shaft.

19. A rotary casting device according to claim 1, characterised in that the shell (2) is maintained axially with possible radial gap, by two circular flanges (4, 4') mounted to rotate on the fixed shaft (1), each via a bearing (41, 42) and each provided with a circular external edge for maintaining the corresponding lateral end of the wall (2), at least an annular sealing joint (46) being interposed between said lateral end of the wall (2) and the widened portion (10) of the fixed shaft (1).

20. A rotary casting device according to claim 19, characterised in that in rotation the shell (2) is linked with at least one of the end flanges (4) by coupling means with clearances (44, 23) enabling differential expansions, whereby the said flange (4) is kinetically bound to a rotation control means (7) carried by the shaft (1) to drive the shell (2) into rotation around its axis (x', x).

21. A rotary casting device according to claim 19, characterised in that an annular sealing joint (45) is interposed between the outer edge of each flange (4, 4') and the corresponding lateral side of the shell (2).

* * * * *